US005845342A

United States Patent [19]

Park

[11] Patent Number: 5,845,342

[45] Date of Patent: Dec. 8, 1998

[54] FACE SHIELD FOR HELMET

[75] Inventor: Soo An Park, Seoul, Rep. of Korea

[73] Assignee: Korea OGK Co., Ltd., Rep. of Korea

[21] Appl. No.: 917,321

[22] Filed: Aug. 25, 1997

[51] Int. Cl.[6] ..... A42B 3/24

[52] U.S. Cl. ..... 2/424; 2/435; 219/211

[58] Field of Search ..... 2/424, 15, 10, 2/9, 435, 410, 422, 6.3, 6.4, 6.5; 219/203, 211

[56] References Cited

U.S. PATENT DOCUMENTS

| | | | |
|---|---|---|---|
| 3,024,341 | 3/1962 | Ogle, Jr. et al. | 2/435 |
| 4,584,721 | 4/1986 | Yamamoto | 2/424 |
| 4,638,728 | 1/1987 | Elenewski | 2/435 |
| 4,868,929 | 9/1989 | Curcio | 2/435 |
| 4,942,629 | 7/1990 | Stadlmann | 2/435 |
| 4,996,981 | 3/1991 | Elenewski et al. | 2/435 |
| 5,351,339 | 10/1994 | Reuber et al. | 2/9 |
| 5,471,036 | 11/1995 | Sperbeck | 2/435 |
| 5,500,953 | 3/1996 | Reuber et al. . | |
| 5,694,650 | 12/1997 | Hong | 2/424 |

FOREIGN PATENT DOCUMENTS 2090805 3/1993 Canada .

*Primary Examiner*—Michael A. Neas
*Attorney, Agent, or Firm*—Dougherty & Dremann

[57] ABSTRACT

A face shield for a helmet. The face shield having a weather lens and a face lens spaced from the weather lens so as to form an air gap, is characterized in that an electroconductive film is attached to the air gap side of the weather lens, in that upper and lower electrodes are printed on upper and lower sides of the electroconductive film, receptively, and in that the weather lens is made from a material such as a polycarbonate, butyrate, or an acrylic, and the face lens from an anti-fog sheet.

2 Claims, 5 Drawing Sheets

FACE SHIELD FOR HELMET

BACKGROUND OF THE INVENTION

1. Field of the Invention

The present invention relates to a face shield for a helmet used for motorcycle, and more particularly to a face shield for a helmet for preventing formation of fog upon an interior surface of the face shield, as well as for effectively thawing snow and ice attached to an exterior surface of the face shield under its use.

The helmet is used for protecting wearer's head when ridding the motorcycle and the face shield is also used for protecting wearer's face from wind, rain, snow, and so on. Various other variations are known in the conventional face shield for the helmet.

2. Discussion of Related Art

As shown in FIG. 1, the face shield 2 is generally mounted on the helmet 1 with a pivot 3 in the center. Thus, if necessary, a wearer can pull down the face shield over a support plate to protect his/her face, and he/she can also pull up it over the support plate to expose his/her face to outside.

U.S. Pat. No. 5,500,953 which issued to Douglas A. Reuber and Amsey Buehler discloses a face shield for a helmet for preventing the formation of fog on the interior surface of the face shield depending upon the temperature difference between inside and outside of the face shield, and also for thawing snow attached to the exterior surface.

The face shield for the helmet according to the prior art, as shown in FIGS. 2 and 3, comprises a weather lens 10 and a face lens 20 spaced from the weather lens by an air gap 30, the weather lens and the face lens being secured to a housing 40. The face lens 20 has a rear lens 21 on a face side and an inner lens 22 on the side of the air gap 30.

The weather lens 10 and the face lens 20 are coextensive and are mounted to the housing 40 so as to form the air gap 30 by a spacer 50. The air gap 30 is maintained to be sealed. The spacer 50 is generally made from a material like neoprene.

In an embodiment shown in FIG. 2, the inner lens 22 of the face lens 20 is spaced from the rear lens 21 thereof by the spacer 23. However, in another preferred embodiment, the inner lens 22 is laminated to the rear lens 21.

Formed on the rear lens 21 is an anti-fog coating 24 in entire face side. The anti-fog coating 24 may be either a hydrophilic coating or a hydrophobic coating, and will inhibit the build-up of fog on the interior surface of rear lens. The rear lens 21 is preferably made from a material such as a polycarbonate, butyrate, or an acrylic.

Attached to the air gap 30 facing surface of inner lens 22 is a transparent electroconductive film 25 which substantially covers the air gap 30. The electroconductive film 25 is a composite product comprising a PET substrate (polyester) to which is applied by a thin layer of indium tin oxide (ITO). Such an ITO coating provides high visible light transmission, low reflectivity and uniform electrical conductivity.

Further, upper and lower electrodes 26 and 27 are printed on the upper and lower parts of the electroconductive film of the inner lens 22. Printed on the lower portion of the air gap 31 facing surface of the inner lens 22 is a conductor 28 for providing current to the lower electrode 27. The upper and lower electrodes and the conductor 28 are made from an electrically conductive silk screen ink.

A contact 60 is mounted through the inner lens 22 and connects an end of the lower electrode 27 to the conductor 28.

An end of the conductor 28 is connected to a terminal 70 and an end of the upper electrode 26 is connected to another terminal 71, the terminals 70 and 71 being mounted through the inner lens and the rear lens.

In the arrangement of the face shield of the prior art, an operation will be explained as follows.

If electric potential is applied to the upper and lower electrodes 26 and 27 through the terminals 70 and 71, the current flows into the electroconductive film 25 therebetween. Once the current flows into the electroconductive film 25, heat is generated. The heat is transmitted to the inner lens, the rear lens, and the air gap.

Thus, there is no difference in the temperature between the inside and outside of the face lens, thereby inhibiting the formation of fog on the interior surface of the face lens, even though it is very cold.

In addition, if air in the air gap 30 is maintained to be warm, it is possible to thaw snow attached to the exterior surface of the weather lens 20.

As mentioned above, the face shield according to the prior art can inhibit the build-up of fog on the rear lens of the face lens. However, in the face shield according to the prior art, there is provided a problem in that it is difficult to effectively eliminate snow attached to the exterior surface of the weather lens 10 because the heat generated in the electroconductive film 25 is transmitted to the weather lens through the air gap 30 and the temperature in the weather lens is not so high thereby.

In particular, in winter having lots of snow, since the snow attached to the weather lens 10 easily becomes ice, it is difficult to thaw the snow by heat of the weather lens 10 in such a case. Thereby, the face shield according to the prior art provides a problem that the snow attached to the face shield for the helmet used for motorcycle, must be eliminated by wearer's hands during use of the motorcycle.

SUMMARY OF THE INVENTION

Therefore, an object of the present invention is to provide a face shield for a helmet for preventing formation of fog, or frost upon an interior surface of the face shield for the helmet, as well as for effectively thawing snow attached to the exterior surface of the face shield under its use.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve the above object in accordance with the present invention, as embodied and broadly described, the face shield is characterized in that an electroconductive film is attached to the air gap facing surface of the weather lens, in that upper and lower electrodes are printed on upper and lower sides of the electroconductive film, respectively, and in that the weather lens is made from a material such as a polycarbonate, butyrate, or an acrylic, and the face lens from an anti-fog sheet.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Reference will now be made in detail to the preferred embodiments of the present invention, examples of which are illustrated in the accompanying drawings.

Figure 1:
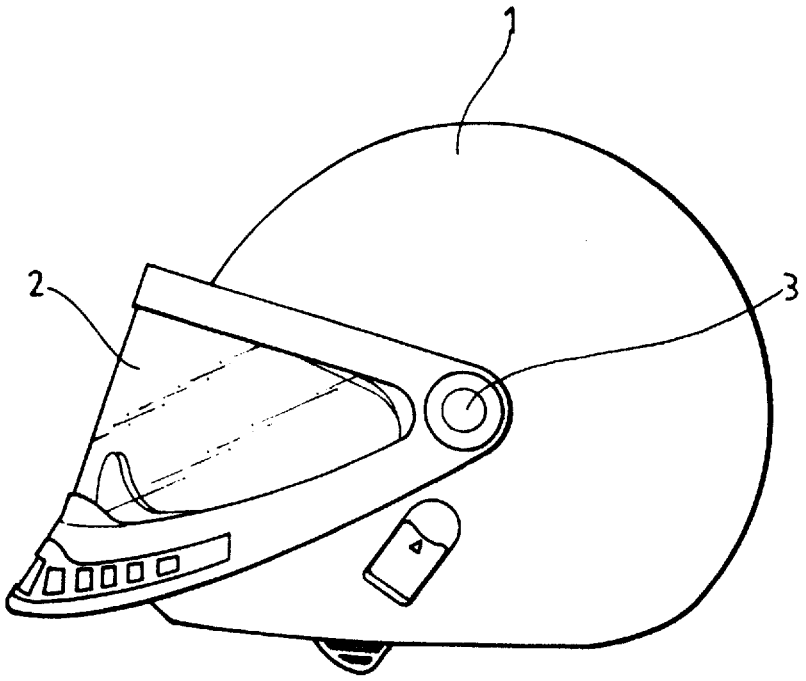
FIG. 1 is a lateral view of a helmet having a face shield.
Figure 2:
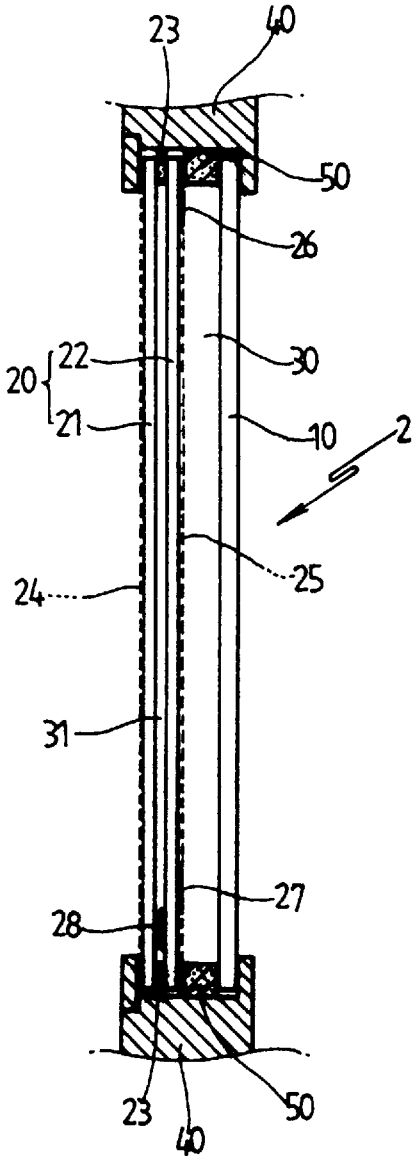
Fig. 2 (Prior Art)
FIG. 2 is a cross-sectional view of a face shield according to the prior art.
Figure 3:
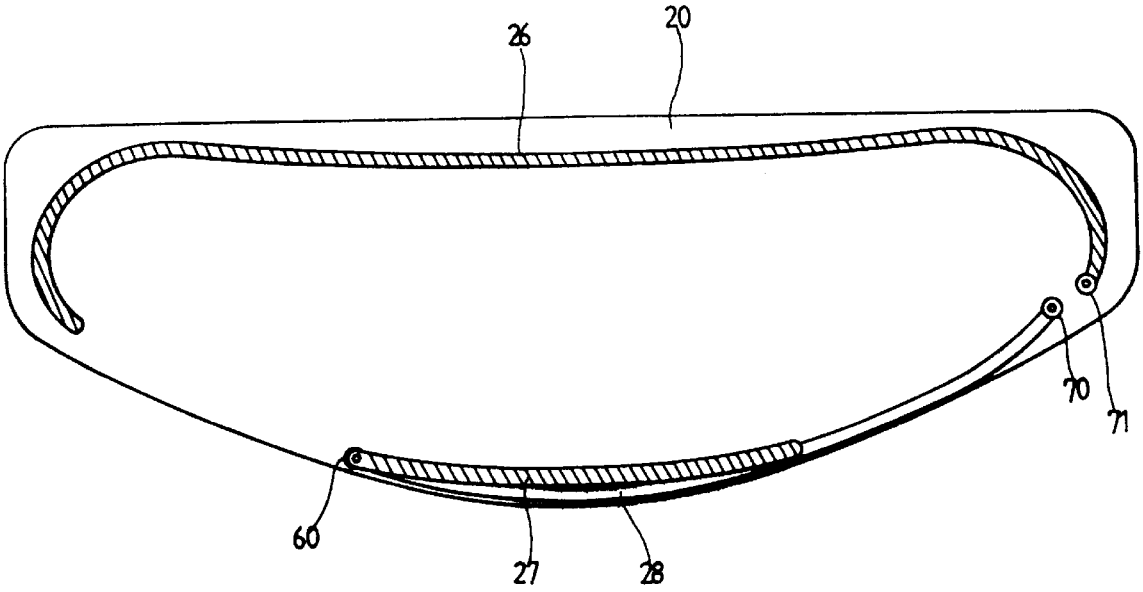
Fig. 3 (Prior Art)
FIG. 3 is a front view of an inner lens of a face lens in an arrangement of a face shield of FIG. 2.
Figure 4:
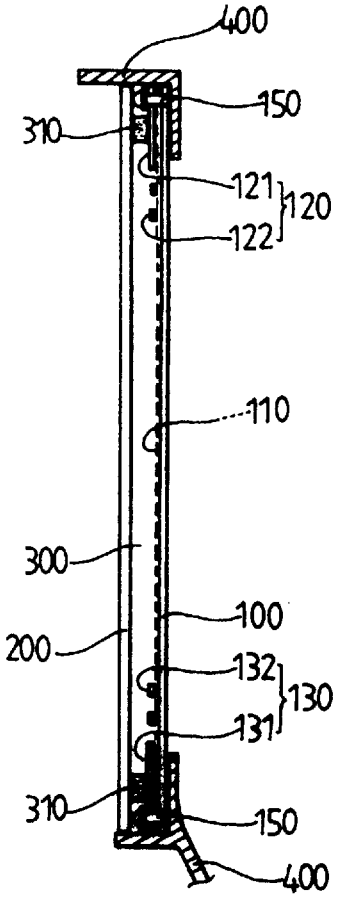
FIG. 4 is a cross-sectional view of a face shield according to the present invention.
Figure 5:
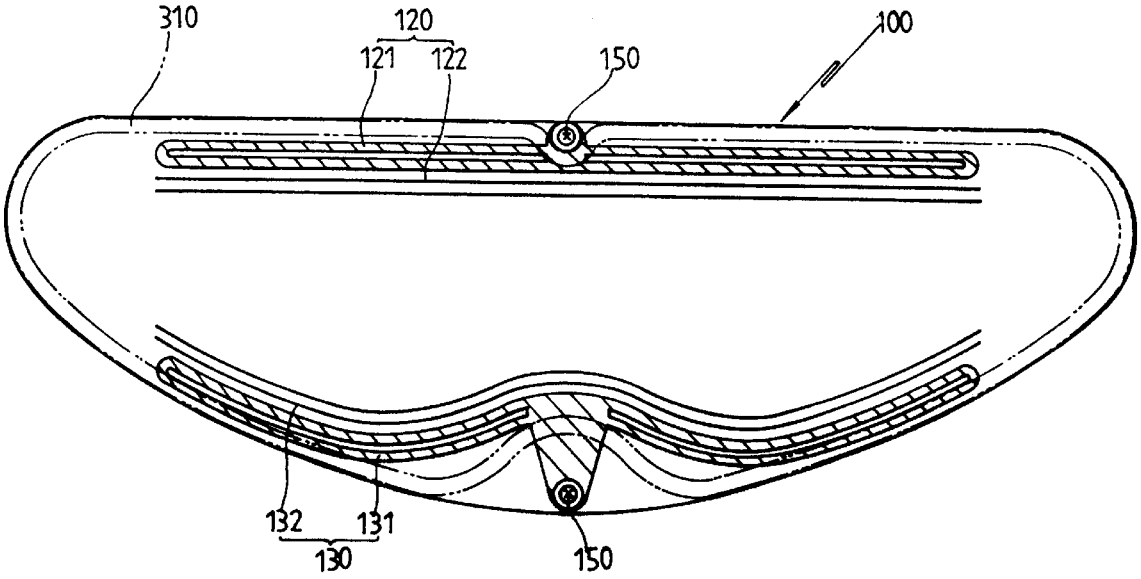
FIG. 5 is a rear view of a weather lens in an arrangement of a face shield of FIG. 4.

FIG. 4 is a cross-sectional view of a face shield according to the present invention. FIG. 5 is a rear view of a weather lens in an arrangement of a face shield of FIG. 4.

As shown, the face shield of the present invention comprises a weather lens 100, and a face lens 200 spaced from the weather lens 100 to form an air gap 300.

Attached to the air gap facing surface of the weather lens 100 is an electroconductive film 110 on which upper and lower electrodes 120 and 130 are each formed.

The electroconductive film 110 is a composite product comprising a PET substrate (polyester) to which is applied a thin layer of indium tin oxide (ITO). Such an ITO coating provides high visible light transmission, low reflectivity and uniform electrical conductivity. Therefore, if electric potential is applied to the upper and lower electrodes 120 and 130, the current flows into the electroconductive film 110 therebetween. Further, such an ITO coating does not screen the wearer's view owing to its transparence.

The upper and lower electrodes are made from an electrically conductive silk screen ink.

As shown in FIG. 5, the upper electrode 120 has two strips 121 which are connected to each other in the central portion, and two lines 122 spaced from the two strips 121. The two lines 122 are beneath the two strips 121, and are far thinner than the two strips 121. On the other hand, the lower electrode 130 has two strips 131 which are connected to each other in the central portion, and two lines 132 spaced from the two strips 131. The two lines 132 are over the two strips 131, and are also far thinner than the two strips 131. The above lines 122 and 132 improve the current flow between the upper strips 121 and the lower strips 131.

Formed on the central parts of the upper electrode 120 and the lower electrode 130, respectively, is a contact 150 for providing power. An electric wire (not shown) connected to the contact 150 is also connected to a terminal (not shown) in a position of a housing 400. The contact 150 is mounted through the weather lens 100.

The weather lens 100 is made from a material such as a polycarbonate, a butyrate, or an acrylic. Further, the exterior surface of the weather lens is treated for hardening so as to inhibit scratch.

The face lens 200 is made from an anti-fog sheet. It is well known that the anti-fog sheet is used for inhibiting the build-up of fog or frost.

In the meantime, a spacer 310 between the weather lens and the face lens is made from a material such as an ethylene vinyl acetate foam.

In the arrangement of the face shield according to the present invention, first of all, the weather lens is adhered to the housing 400 and the spacer 310 also adheres to the inner side of the weather lens 100. And, to the other end of the spacer 310 is adhered the face lens 200.

In the face shield of the preferred embodiment of the present invention, operations will be explained as follows.

If power is applied to the terminal in the housing 400, the power is provided to the upper and lower electrodes 120 and 130 of the inner side of the weather lens through the electric wire and the contacts 150. This means that the electric potential is applied to the upper and lower electrodes 120 and 130.

Thereby, current flows into the electroconductive film 110 attached to the weather lens 100. The electroconductive film 110 generates heat by the current. The heat keeps the weather lens warm and also maintains warm the air gap 300 between the weather lens 100 and the face lens 200.

As mentioned above, since the present invention unlike the prior art, is to directly transmit the heat generated in the electroconductive film 110 to the weather lens 100, lots of amount of heat are provided to the weather lens to thereby highly raise the temperature in the weather lens. This results in effectively thawing snow and ice attached to the exterior surface of the weather lens 100 during the use of the face shield.

The heat of air in the air gap 300 is transmitted to the face lens 200 and makes it warm. Thus, since there is no difference in the temperature between the inside and outside of the face lens 200, it is possible to inhibit the build-up of fog on the interior surface of the face lens 200.

Even though the temperature of the face lens 200 is a little lower than that of the weather lens 100, since the face lens 200 is made from the anti-fog sheet and the electroconductive film 110 is subjected to block the lower temperature from outside, it is possible to inhibit the formation of fog on the interior surface of the face lens 200.

Further, in accordance with the present invention, there are provided the two strips 121 and 131 and two lines 122 and 132 in the upper and lower electrodes 120 and 130, so that it is possible to enhance the amount of the heat by the current flow into the center portion of the electroconductive film 110. Therefore, there can be effectively thawed the snow and ice attached to the exterior surface of the weather lens 100. Furthermore, even if the heating value becomes high as mentioned above, since the upper and lower electrodes include the two thin lines 122 and 132 in the vicinity of center portion of the weather lens 100, respectively, the wearer's view is not disturbed with the electrodes.

As mentioned above, since the present invention is to attach the electroconductive film 110 to the interior surface of the weather lens 100, it is possible to maintain it high the temperature in the weather lens, thereby effectively thawing snow and ice attached to the exterior surface of the weather lens 100.

Further, since the upper and lower electrodes 120 and 130 are implemented in somewhat near location, the uniform heat is generated even in the center portion of the electroconductive film 110, thereby effectively thawing snow and ice attached to the exterior surface of the weather lens 100.

Furthermore, according to the present invention, since the face lens is made from the anti-fog sheet and the electroconductive film is subjected to block the lower temperature from outside, even if the amount of the heat provided to the face lens 200 is a little low, it is possible to definitely inhibit the formation of fog on the interior surface of the face lens 200.

It will be apparent to those skilled in the art that various modifications and variations can be made in the face shield for the helmet of the present invention without departing from the spirit or scope of the invention. Thus, it is intended that the present invention cover the modifications and variations of this invention provided they come within the scope of the appended claims and their equivalents.

What is claimed is:

1. A face shield for a helmet having a weather lens and a face lens spaced from said weather lens to form an air gap therebetween, characterized in that an electroconductive film is attached to the surface of said weather lens facing said air gap, in that upper and lower electrodes are printed on upper and lower sides of said electroconductive film, respectively, and in that said weather lens is made from a material selected from the group consisting of a polycarbonate, a butyrate, and an acrylic, and said face lens is made from an anti-fog sheet;

wherein said upper electrode comprises two strips which are connected to each other and two lines spaced from said two strips, said two lines being beneath said two strips and being substantially thinner than said two strips, wherein said lower electrode comprises two strips which are connected to each other and two lines spaced from said two strips, said two lines in said lower electrode being over said two strips in said lower electrode and being also substantially thinner than said two strips; and wherein a contact is installed in the central portions of each of said upper and lower electrodes, respectively.

2. The face shield as claimed in claim 1 wherein the exterior surface of said weather lens is embodied by a hardening treatment.

* * * * *